US005947207A

United States Patent [19]

Conforti et al.

[11] Patent Number: 5,947,207

[45] Date of Patent: Sep. 7, 1999

[54] DUAL SPRINKLER SYSTEM

[75] Inventors: Fred J. Conforti, Wheaton; George A. Schoenfelder, Batavia, both of Ill.

[73] Assignee: Pittway Corporation, Chicago, Ill.

[21] Appl. No.: 08/829,586

[22] Filed: Mar. 31, 1997

[51] Int. Cl.[6] ..... A62C 37/10; A62C 37/21

[52] U.S. Cl. ..... 169/47; 169/61

[58] Field of Search ..... 169/19, 46, 47, 169/56, 57, 60, 61, 93

[56] References Cited

U.S. PATENT DOCUMENTS

| | | | |
|---|---|---|---|
| 3,684,019 | 8/1972 | Emmons et al. | 169/47 |
| 4,079,786 | 3/1978 | Moling | 169/78 |
| 4,583,597 | 4/1986 | Spector et al. | 169/61 |
| 5,597,044 | 1/1997 | Roberts et al. | 169/37 X |

FOREIGN PATENT DOCUMENTS

| | | | |
|---|---|---|---|
| 1459668 | 2/1989 | U.S.S.R. | 169/19 |

*Primary Examiner*—Kevin Weldon
*Attorney, Agent, or Firm*—Rockey, Milnamow & Katz, Ltd.

[57] ABSTRACT

A dual mode fire suppression system includes first and second, different, fire suppression nozzles. Each nozzle is coupled to a fire suppressing medium. A fire detector is coupled to at least one of the nozzles. The detector monitors an adjacent region, and, is insensitive to the medium associate with the coupled nozzle. In the presence of a detected first fire condition, the detector activates the coupled nozzle which releases the respective medium. The detector continues to monitor the adjacent region and in the absence of the first fire condition, the first nozzle is deactivated. In the presence of a detected second fire condition, different from the first condition, the second nozzle is activated.

33 Claims, 3 Drawing Sheets

DUAL SPRINKLER SYSTEM

FIELD OF THE INVENTION

The invention pertains to fire suppression sprinkler systems. More particularly, the invention pertains to such systems which incorporate two different types of fire suppression systems.

BACKGROUND OF THE INVENTION

Relatively high volume, water fed sprinkler systems are known for use in suppression of fire conditions in regions being supervised. In such systems, sprinkler heads are often coupled to water carrying pipes or conduits. In response to the presence of heat, a heat sensitive element melts or changes state thereby releasing a flow of fire suppressing water into the immediately adjacent region. Water sprinkler systems can also be coupled to and controlled by fire detectors or other types of control units where automatic stand-alone operation is not desirable.

Known sprinkler systems have a disadvantage in that when activated, they deliver large quantities of water to the respective region. In addition to suppressing a fire condition, the water can in turn create additional damage to equipment in the region.

Mist-type sprinkler heads are also known. Instead of a water spray, these heads expel water vapor or mist into the adjacent area for fire suppression. While effective, mist-type heads may not in and of themselves supply enough moisture to suppress every fire.

Chemical fire suppression systems are also known. Such systems respond to the presence of a fire condition by releasing inert, oxygen displacing chemicals which are intended to smother or suppress a fire.

Chemical suppression systems do not create water damage as do known sprinkler systems. Nevertheless, chemical suppression systems create other forms of damage, due to the release of chemicals into the atmosphere. The suppression chemicals also end up being deposited on equipment in the area where the fire is being suppressed. Further, resultant residues from the released chemicals need to be removed subsequent to suppression of the fire for various environmental reasons.

Known chemical suppression systems at times use halogenated hydrocarbons as fire suppressants. Such hydrocarbons may function as ozone depleting agents and as a result may negatively affect the environment.

There continues to be a need for controllable systems which could be used with known water sprinkler systems or known chemical suppression systems. Preferably, such controllable systems would themselves not create significant water damage when activated, nor significantly increase the cost of installation.

SUMMARY OF THE INVENTION

A dual sprinkler system incorporates a mist-type sprinkler in combination with a high volume spray-type water suppression system. In one aspect, an ambient condition detector is coupled by a control unit to at least the mist-type suppression system.

The control unit may be within the detector or it may be displaced therefrom. The detector should be insensitive to the water mist.

In one aspect the detector could incorporate a smoke sensor and a mist excluding filter such that products of combustion are admitted to the detector but the filter substantially excludes water mist therefrom. Alternately, the detector could incorporate a gas sensor.

In response to a detected ambient condition, indicative of an alarm condition in a region being monitored, the detector, via the control unit, can activate the mist-type spray system to disburse water vapor throughout the region associated with the alarm condition. While the mist is being disbursed the detector can continue to monitor the ambient condition.

In one aspect, the ambient condition can correspond to products of combustion. In response to ongoing sensed products of combustion, the detector, via the control unit, can activate the second or high volume-type sprinkler system.

Alternately the detector can continue to monitor the region while permitting the mist-type system to continue to operate to try to suppress the fire on its own. In response to a declining indication of smoke or products of combustion, the control unit can terminate the operation of the primary or mist-type system.

In a further aspect, both visual and audible alarms can be provided in response to the detected alarm condition. The control unit can also be coupled to and in communication with a plurality of ambient condition detectors.

In yet another embodiment, a mist-type sprinkler is coupled to a control unit and functions as described above. An adjacent high volume water sprinkler head can be activated independently of the mist-type sprinkler in response to the presence of heat. Both types of sprinklers could be carried, if desired, on a single fixture.

In accordance with the invention, the mist-type head has a higher sensitivity to a predetermined fire condition than does the spray-type head. Hence, the mist-type head is activated before the spray-type head.

If the mist-type head is coupled to the smoke detector, a relatively low level of smoke, or alternate a selected rate of rise of a thermal sensor, can be used to activate that head. The spray head can be coupled to a thermal sensor or a fusable (200° F.) link. The thermal sensor link is intended to activate the spray-type head in the presence of a greater fire condition, higher temperature for example, than is the case with the mist-type head.

In another embodiment, the mist-head can be activated with a fusable link that melts on the order of 135° F. The spray head can be activated with a 200° F. link. Both heads can be carried on a common fixture.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figures 1A, 1B:
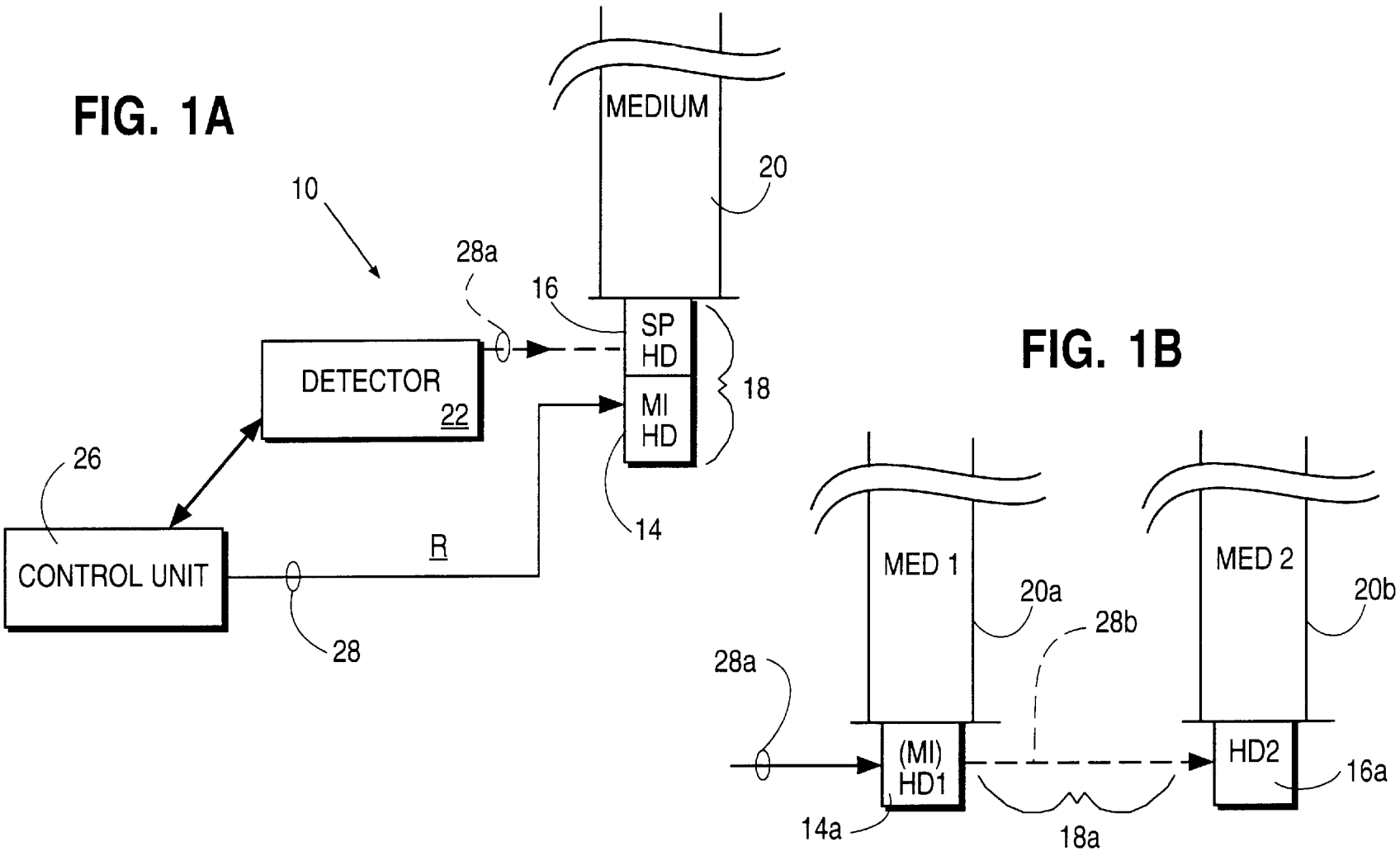
FIG. 1A is a block diagram of a controllable suppression system.
FIG. 1B is a diagram of an alternate nozzle arrangement.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1A illustrates a dual sprinkler system 10. The system 10 includes a mist-type sprinkler head 14 and a high volume spray-type sprinkler head 16. In the embodiment of FIG. 1A, both sprinkler heads are carried on a common fixture 18 and are coupled to a water supply conduit or pipe 20.

The sprinkler heads 14 and 16 are located in a region R being supervised. An ambient condition detector 22 is also located in the region R.

The detector 22 is intended to monitor an ambient condition in the region R. The detector 22 would for example preferably be a smoke detector. Gas detectors, flame detectors, or heat detectors could also be used without departing from the spirit and scope of the present invention. A thermal rate of rise detector could also be used.

The detector 22 is in turn coupled to a control unit 26. The control unit 26 can be incorporated into the detector 22 or it can be displaced therefrom a substantial distance. In the former case, the control unit 26 would be directly wired to the detector 22. In the later case, the control unit 26 could communicate with the detector 22 via a plurality of communication links which could be bi-directional. The detector 22 and unit 26 could be incorporated into the head 14.

The control unit 26 includes circuitry for the purpose of analyzing one or more signals from the detector 22 so as to determine if a preset condition is present in the region R being monitored. For example, if the detector 22 includes a smoke sensor, control unit 26 could compare the output from the detector 22, which is proportional to a sensed level of smoke or products of combustion in the region R to one or more prestored threshold values for the purpose of ascertaining if a sufficient level of smoke is present to indicate an alarm condition. Alternately, if the detector 22 includes a heat sensor, the control unit 26 could process those signals in an analogous fashion to determine if a sufficient level of heat is present in the region R to indicate the presence of a fire.

The control unit 26 is in turn coupled to at least a mist-type head 14 via lines 28. In response to the presence of, for example, a predetermined level of smoke or first predetermined level of heat in the region R, the control unit 26 via lines 28 is adapted to activate the head 14 causing it to inject water mist into the region R for the purpose of suppressing the detected condition.

It will be understood that the control unit 26 could also include circuitry for the purpose of processing signals from the detector 22 to remove noise or other undesirable signals present on the output of detector 22 in addition to the signals indicative of the sensed ambient condition. The control unit 26 could be implemented for example as hard wire circuitry which could include hard wired filter elements. Alternately, control unit 26 could incorporate a programmed processor, and an associated control program, for the purpose of carrying out software directed processing methods which could include digital signal processing for the purpose of filtering and smoothing the signals from the detector 22.

Subsequent to the control unit 26 activating the head 14, the detector 22, in combination with the control unit 26, continues to monitor the sensed condition associated with the region R to determine whether or not the fire condition is being suppressed. In the event that the control unit 26 determines that signals from the detector 22 no longer indicate the presence of a fire condition, it can deactivate head 14 via signals on the lines 28.

Alternately, in the event that the head 14 is unable to suppress the fire condition, spray head 16 can be activated so as to spray a greater quantity of water into the region R for the purpose of suppressing the fire condition. In this embodiment, the spray head 16 is less sensitive than the mist head 14 and will be activated at a greater level of heat. For example, head 14 can be activated at a relatively lower level of ambient smoke. Spray head 16 can be activated at a temperature for example in a range of 175°–200° F. ambient temperature.

A thermal detector can be carried in detector 22 and coupled via lines 28*a* to the head 16. Alternately, the spray head 16 can be activated automatically if it is the type which includes a heat sensitive element that melts or deforms in the presence of sufficient heat (175°–200° F.).

In another embodiment, the control unit 26 could be incorporated into head 14 as a spring loaded or a solenoid control valve. In such an instance, the detector 22 could be a fusible heat sensitive link incorporated into head 14. A similar, independent link could be incorporated into spray head 16. In this embodiment, no separate electronic circuitry is needed. The heat-sensitive link for the spray head 14 could fuse or melt at a temperature on the order of 135° F. (the head 14 is more sensitive). The link for the head 16 could fuse or melt at a higher temperature, on the order of 200° F. Hence, it is less sensitive.

Alternately, as illustrated in FIG. 1B and discussed subsequently, the control unit 26 can be adapted to energize the spray head independently of energizing the mist head 14. Unlike the arrangement of FIG. 1A, where both spray heads are carried on a common fixture 18, spray heads 14*a* and 16*a* can be carried on separate fixtures and associated with separate conduits 20*a* and 20*b*. If desired, the heads 14*a*, 16*a* can be laterally disposed on a common fixture 18*a* and still be coupled to separate conduits 20*a* and 20*b*. Further as illustrated in FIG. 1B, separate control signals 28*a* and 28*b* can be provided by control unit 26 to independently activate or deactivate the heads 14*a* and 16*a*.

Figure 2:
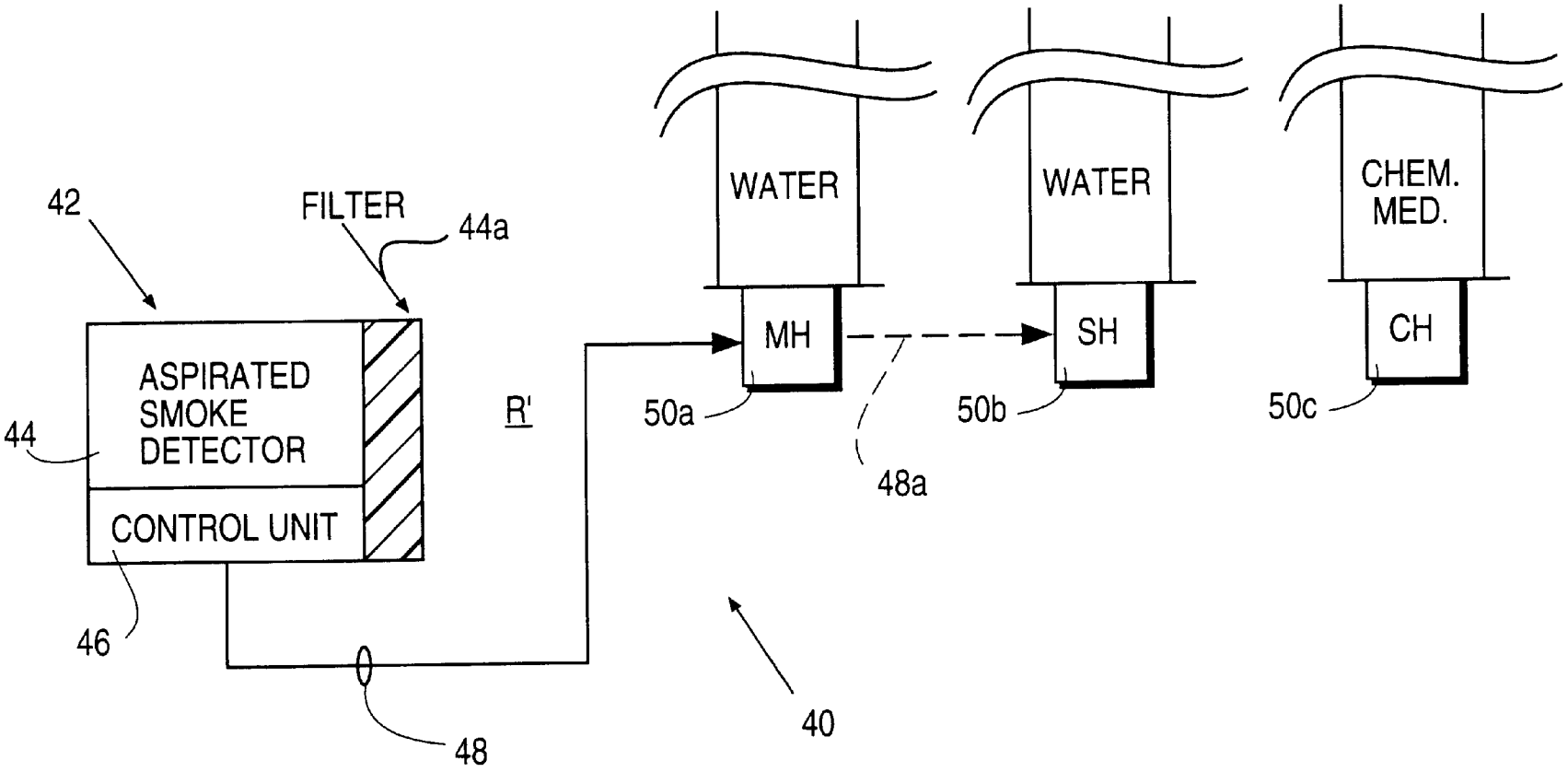
FIG. 2 is a block diagram of an aspirated detector in a dual nozzle suppression system.

FIG. 2 illustrates a specific configuration of a dual mode sprinkler system 40 in a region R'. The system 40 includes an aspirated smoke detector 42.

The detector 42 includes a housing 44 which carries a water mist excluding filter, such as a micropore filter 44*a*. The filter 44*a* is intended to exclude aerosol-like water mist from the sensing region within the housing 44. The filter 44*a* is substantially transparent to other aerosols or products of combustion which might be present in a region R' being monitored by the detector 42. The detector 42 also includes a control unit 46 which is also carried by the housing 44.

The detector 42 could be operated as either a stand alone device or as part of a larger alarm system. Aspirated detectors similar to detector 42 have been disclosed and described in prior pending patent application Ser. No. 08/740,203 entitled ASPIRATED DETECTOR, filed Oct. 24, 1996. The above noted application is assigned to the assignee of the present invention and incorporated herein by reference.

Output from the control unit 46 on lines 48 is coupled to at least a misting type spray head 50*a* located in the region R'. In the same region R6' is one of either a water spray head 50*b* or a chemical fire suppressant dispensing head 50*c*. For example, 50*c* could be part of a chemical suppression system which injects an oxygen displacing medium such as HALON gas into the region R' when activated. Spray heads 50*b* or 50*c*, whichever is chosen, could be coupled to the control unit 46 by lines 48*a*, illustrated in phantom in FIG. 2, or could be intended to operate completely independently of the detector 42.

While a water mist resistant aspirated smoke detector 42 is illustrated in the system 40, it will be understood that other forms of detectors, insensitive to the primary form of fire suppressing medium, such as water mist, could be substituted for the detector 42 without departing from the spirit and scope of the present invention. Possibilities include gas detectors or heat detectors for example.

Figure 3:
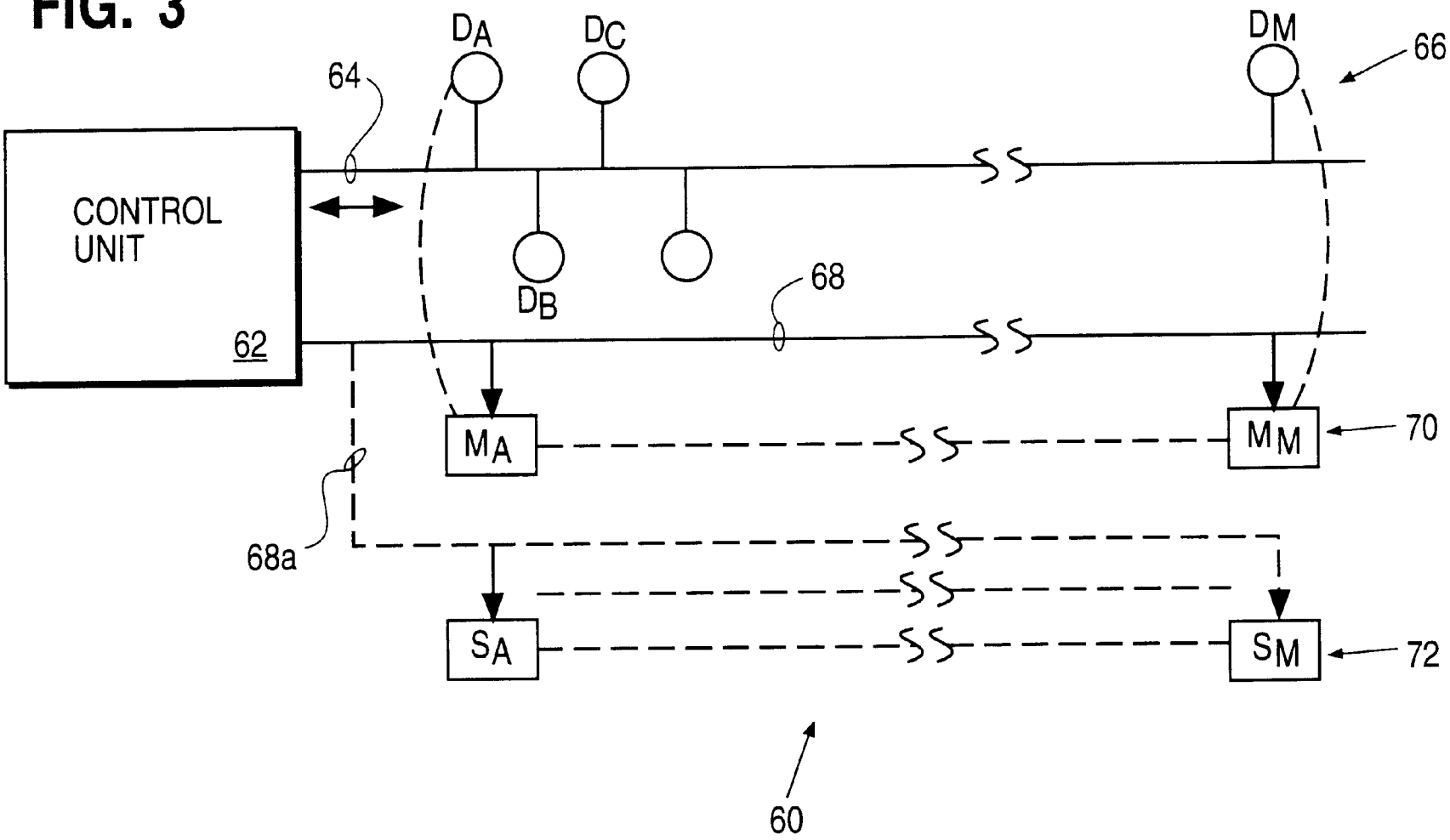
FIG. 3 is a block diagram of a dual suppression alarm system.

FIG. 3 illustrates yet another embodiment, an alarm system 60. The alarm system 60 includes a control unit 62 which is coupled via a communication link 64, which could be bidirectional, to a plurality of detectors 66. The members of the plurality 66, including detector DA . . . DM could be smoke or fire detectors without departing from the spirit and scope of the present invention. Each of the members of the plurality 66 is intended to monitor a selected condition, such as smoke heat or a gas in an adjacent associated region.

The control unit 62 includes a second communication link 68 to which is coupled a plurality of fire suppression heads 70. The members of the plurality 70, MA . . . MM, could be water mist-type suppression heads.

Each of the members of the plurality 70 is associated with a respective member of the plurality of detectors 66. In this regard, detector DA is associated with suppression head MA. Further, the members of a plurality 66 are insensitive to aerosol-like outputs from the members of the plurality 70.

The control unit 62 includes circuitry for analyzing signals received from the members of the plurality 66 and for determining the presence of a predetermined fire or alarm condition in a respective region. As a result of such a determination, control unit 62 via communication link 68 activates one or more of the members of the plurality 70 thereby injecting aerosol-like suppression medium into one or more regions associated with one or more members of the plurality 66. As noted above, the members of the plurality 66 are insensitive to an aerosol-like outputs from the members of the plurality 70.

An additional plurality of suppression heads 72 $S_A \ldots S_M$ is, as illustrated in FIG. 3, associated with the members of the plurality 70. The members of the plurality 72, when activated, inject another form of a fire suppressing medium into the respective region. For example, the members of the plurality 72 could be water spray or chemical dispensing suppression heads.

The members of the plurality 72 could be adapted to activate automatically in response to the presence of heat or fire. Alternately, they could be coupled to the control unit 62 via lines 68*a* and be activated, individually or as a group, by the control unit 62 in response to the continuing presence of a fire or alarm condition not withstanding the activated state of one or more of the members of the plurality 70 for the purpose of suppressing the respective fire condition.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system for suppressing a fire in an adjacent region comprising:

a first suppression nozzle for expelling a first fire suppressing medium into a region when activated;

a second suppression nozzle adjacent to the first nozzle, for expelling a second, fire suppressing medium into the region when activated;

a control element coupled to at least the first nozzle;

a gas sensor, coupled to the control element, for detecting a predetermined fire indicating parameter in the region, said fire indicating parameter being the presence of products of combustion, and said gas sensor for generating a fire indicating electrical signal corresponding thereto wherein the sensor is responsive substantially only to the parameter and is not responsive to the presence of the first fire suppressing medium, wherein the control element includes circuitry responsive to the fire indicating signal, for activating the first fire suppressing nozzle in response to the presence of a predetermined fire condition thereby expelling the first medium into the region; and wherein the second suppression nozzle is activated in response to a subsequent failure of the first medium to suppress the fire condition.

2. A system as in claim 1 wherein the first nozzle is adapted to expel, when activated, an aerosol-like water mist and wherein the sensor does not respond to water mist present in the region.

3. A system as in claim 2 wherein the sensor corresponds to a smoke detector which is insensitive to water mist in the region.

4. A system as in claim 2 which includes a fixture and wherein the fixture carries the nozzles.

5. A system as in claim 2 wherein the second medium corresponds to water expelled as a spray from the second nozzle.

6. A system as in claim 2 wherein the second medium corresponds to a fire suppressing gas expelled from the second nozzle.

7. A system as in claim 3 wherein the second nozzle incorporates a heat sensitive element for releasing the second medium.

8. A system as in claim 1 wherein the second nozzle incorporates a heat sensitive element for releasing the second medium.

9. A system as in claim 1 wherein the control element includes circuitry for deactivating the first nozzle in response to the subsequent absence of the fire condition.

10. A dual mode fire suppression system comprising:

a first nozzle for expelling, when activated, a first aerosol-like suppression medium, into a region being monitored;

a second different nozzle for expelling, when activated, a second fire suppression medium into the region;

a detector of airborne products of combustion wherein the detector includes circuitry for generating an output indicative of sensed products of combustion in the region and a filter, wherein the filter excludes airborne aerosols of the first medium from the detector and wherein the detector is insensitive to the first medium;

a control unit coupled to the detector and to at least the first nozzle, wherein the control unit in response to the output from the detector, determines if combustion is present in the region and in response to the presence of the combustion activates the first nozzle thereby expelling the first aerosol-like suppression medium and wherein subsequently the control unit, in response to suppression of the products of combustion, by the first medium, deactivates the first nozzle.

11. A system as in claim 10 wherein notwithstanding the activation of the first nozzle, the second nozzle is activated in response to the presence of an increasing combustion condition in the region.

12. A system as in claim 11 wherein the first medium corresponds to an aerosol-like water mist.

13. A system as in claim 12 wherein the second medium corresponds to water spray.

14. A system as in claim 12 wherein the second medium corresponds to a non-aqueous oxygen displacing chemical.

15. A system as in claim 11 which includes a mounting fixture and wherein the nozzles are carried by the fixture.

16. A system as in claim 11 wherein the second nozzle includes a heat meltable activating element whereby in response to the presence of a predetermined level of heat adjacent thereto the activating element releases the second medium.

17. A system as in claim 10 wherein the detector includes a gas sensor.

18. An ambient condition alarm system for supervising a region, the system comprising:

a control unit;

a plurality of smoke detectors coupled to and in communication with the control unit whereby the detectors are adapted to be located in spaced apart relationship in the region and to generate electrical signals indicative of a selected ambient condition and wherein the detectors are insensitive to the first medium;

first and second, different suppression systems wherein each of the suppression systems includes a plurality of medium releasing nozzles, wherein the first system is coupled to the control unit wherein the control unit receives the signals from the detectors, wherein the control unit includes circuitry for processing the signals and for establishing the presence of an alarm condition adjacent to at least one of the detectors; and output circuitry, coupled to the control unit, for activating at least one nozzle of the first suppression system in response to the alarm condition and wherein the control unit continues to process the signals.

19. A system as in claim 18 wherein the first medium corresponds to an aqueous fluid expelled as an aerosol-like mist from the one nozzle.

20. A system as in claim 18 wherein subsequent to activation of the one nozzle, a nozzle coupled to the second suppression system is also activated.

21. A system as in claim 18 which includes a plurality of fixtures wherein each fixture carries a nozzle associated with each suppression system.

22. A suppression system comprising:

a first water mist generating, suppression system;

a second, different suppression system coupled to the first system;

a detector of combustion wherein the detector includes a filter for substantially excluding at least airborne water molecules, wherein the detector is coupled to at least the first suppression system, and in response to a predetermined indication of combustion, the first suppression system is activated to generate mist and wherein in response to another indication of combustion, the second system assumes an active suppression state.

23. A system as in claim 22 wherein the detector includes a sensor of combustion products.

24. A system as in claim 22 wherein the detector includes circuitry to terminate activation of the first suppression system in response to the absence of the predetermined indicator of combustion.

25. A method of fire suppression comprising:

providing a monitoring element;

monitoring a selected ambient condition in a selected region using the element;

determining, based on the monitored condition, if a fire is likely to be present in the region;

releasing a first aerosol-like fire suppressing medium into the region in response to the determination;

providing a substantially aerosol free volume in the vicinity of the element; and continuing to monitor the ambient condition without exhibiting substantially any sensitivity to aerosols associated with the first medium.

26. A method as in claim 25 which includes:

in the subsequent absence of the fire, terminating release of the first medium.

27. A method as in claim 19 wherein the first and second media correspond respectively to a mist-like aqueous fluid and a spray-like aqueous fluid.

28. A method as in claim 19 wherein the first and second media correspond respectively to a aqueous fluid and a non-aqueous, oxygen displacing gas.

29. A method as in claim 18 which includes:

establishing that, subsequent to release of the first medium, a predetermined event has taken place and in response thereto, releasing a second fire suppressing medium.

30. A method as in claim 29 wherein the predetermined event corresponds to one of a heat level in the region exceeding a predetermined value and a predetermined rate of increase of heat exceeding a predetermined value.

31. A system for suppressing a fire comprising:

a first suppression nozzle for expelling a first fire suppressing medium into a region when activated;

a second suppression nozzle adjacent to the first nozzle, for expelling a second, fire suppressing medium into the region when activated;

a control element coupled to at least the first nozzle;

a sensor, coupled to the control element, for detecting a predetermined fire indicating parameter in the region and for generating a fire indicating electrical signal corresponding thereto wherein the sensor is not responsive to the presence of the first fire suppressing medium, wherein the control element includes circuitry responsive to the fire indicating signal, for activating the first fire suppressing nozzle in response to the presence of a predetermined fire condition thereby expelling the first medium into the region;

wherein the second suppression nozzle is activated in response to a subsequent failure of the first medium to suppress the fire condition;

wherein the first nozzle is adapted to expel, when activated, an aerosol-like water mist; and wherein the sensor corresponds to a smoke detector which includes a water mist rejecting filter and, as a result, is insensitive to water mist in the region.

32. A dual mode fire suppression system comprising:

a first nozzle for expelling, when activated, a first aerosol-like suppression medium, into a region being monitored;

a second different nozzle for expelling, when activated, a second fire suppression medium into the region;

a detector of airborne products of combustion wherein the detector includes circuitry for generating an output indicative of sensed products of combustion in the region;

a control unit coupled to the detector and to at least the first nozzle, wherein the control unit in response to the output from the detector, determines if a predetermined level of combustion is present in the region and in response to the presence of the predetermined combustion activates the first nozzle thereby expelling the first aerosol-like suppression medium and wherein subsequently the control unit, in response to suppression of the products of combustion, by the first medium, deactivates the first nozzle; and a filter, carried by the detector, wherein the filter excludes airborne aerosols of the first medium from the detector.

33. A system as in claim 32 wherein the housing carries a smoke sensor at least partly within the internal region.

* * * * *